United States Patent [19]

Ike et al.

[11] Patent Number: 4,800,321

[45] Date of Patent: Jan. 24, 1989

[54] HIGH PRESSURE SODIUM LAMP

[75] Inventors: Yujiro Ike, Yokohama; Akihiro Yonezawa; Shinichi Ooshima, both of Yokosuka; Akihiro Kamiya,- Yokohama; Yoshio Hirose, Tokyo, all of Japan

[73] Assignee: Kabushiki Kaisha Toshiba, Kawasaki, Japan

[21] Appl. No.: 81,728

[22] Filed: Aug. 5, 1987

[30] Foreign Application Priority Data

Aug. 5, 1986 [JP] Japan ..... 61-182648

[51] Int. Cl.[4] ..... H01J 61/20; H01J 17/22

[52] U.S. Cl. ..... 313/639; 313/565; 313/573; 313/634; 313/642

[58] Field of Search ..... 313/639, 642, 565, 573, 313/634

[56] References Cited

U.S. PATENT DOCUMENTS

| | | | |
|---|---|---|---|
| 3,398,312 | 8/1968 | Edris et al. | 313/642 |
| 3,575,630 | 4/1971 | Edris | 313/639 |
| 3,898,504 | 8/1975 | Akutsu et al. | 313/639 X |
| 3,974,410 | 8/1976 | Collins et al. | 313/565 X |
| 3,979,624 | 9/1976 | Liu et al. | 313/639 X |
| 4,342,939 | 8/1982 | Mcvey | 313/565 |
| 4,581,557 | 4/1986 | Johnson | 313/639 X |
| 4,639,639 | 1/1987 | Hirayama et al. | 313/639 |

FOREIGN PATENT DOCUMENTS 43-17792 7/1968 Japan .

50-34871 11/1975 Japan .

56-54656 12/1981 Japan .

*Primary Examiner*—David K. Moore

*Assistant Examiner*—Michael Horabik

*Attorney, Agent, or Firm*—Oblon, Fisher, Spivak, McClelland, & Maier

[57] ABSTRACT

A high pressure sodium lamp includes an arc tube having an inner diameter greater than 12 mm. An amalgam including a prescribed quantity of sodium and mercury is sealed in the arc tube. To achieve the maximum lamp efficiency in different values of the inner diameter of the arc tube, the lamp should satisfy the following relationships:

$$(10^{0.848}\phi^{(-0.171)}\log X+(0.105\phi-10.22)$$

$$<\log Y<$$

$$(10^{0.848}\phi^{(-0.171)}\log X-10^{1.43}\phi^{(-0.574)}), \text{ and}$$

$$(-7.97\log\phi+14.8)<\log \Delta V<(84.7\log\phi-84.5)$$

where $\phi$ (mm) is the inner diameter of the arc tube, X (wt %) is the ratio of the quantity of sodium to the quantity of amalgam sealed in the arc tube, Y (mg/cc) is the quantity of sodium sealed in the arc tube, and $\Delta V$ (v/cm) is the electric field strength when the lamp is operated.

5 Claims, 14 Drawing Sheets

HIGH PRESSURE SODIUM LAMP

BACKGROUND OF THE INVENTON

1. Field of the Invention

The present invention relates, in general, to high pressure sodium lamps. In particular, the invention relates to a saturated vapor pressure type sodium lamp having an arc tube wherein an excess amount of mercury and sodium are provided in an amalgam state, and almost all amalgam is accumulated at the coolest portion of a metal tube attached to one of the ends thereof. A proper amount of starting rare gas also is sealed in the arc tube.

2. Description of the Prior Art

High pressure sodium lamps have, in general, a high efficiency. The sodium lamps are widely used as light sources for lighting wide areas, e.g., parking places, open spaces, etc.

Recently, there has been a greater demand for high efficiency and large luminous flux arc lamps. Such a high efficiency high pressure sodium lamp may be obtained by increasing the diameter of the arc tube of the lamp (hereinafter referred to as a conventional design technique). In general, the efficiency of the high pressure sodium lamp depends on the inner diameter of the arc tube, the amalgam sodium ratio in the tube and the electric field strength of the tube. The amalgam sodium ratio is the ratio of the sodium in the amalgam to the amalgam which are sealed in the arc tube of the high pressure sodium lamp. The electric field strength is obtained by dividing the voltage applied between a pair of electrodes of the lamp by the length of the arc tube.

In conventional high pressure sodium lamps, metal vapor having a proper amount of sodium and a prescribed amalgam sodium ratio which correspond to the inner diameter of an arc tube, as shown in FIG. 1, is sealed in each arc tube. Furthermore, each lamp having the above-described arc tube is operated under the prescribed electric field strength corresponding to the inner diameter of the arc tube, as shown in FIG. 2. However, if the diameter of the arc tube is increased to achieve a large luminous flux, the lamp efficiency initially increases to a maximum value when the inner diameter of the arc tube is about 12 mm, and then sharply decreases as the inner diameter is increased further, as indicated by the dotted curved line in FIG. 3. This is because, with the increase of the inner diameter of the arc tube beyoned 12 mm, the quantity of sodium vapor, located near the wall of the arc tube, which absorbs D-resonance rays from the arc increases, while the heat loss from the end portions of the arc tube decreases.

As described above, if the conventional design technique is applied to an arc tube having a large inner diameter, the lamp efficiency sharply decreases when the inner diameter is greater than 12 mm. Therefore, the efficiency of the high pressure sodium lamp is adversely affected, and it is difficult to put a high efficiency sodium lamp to practical use.

SUMMARY OF THE INVENTION

It is an object of the present invention to maintain a substantially stable lamp efficiency when the inner diameter of an arc tube of a high pressure sodium lamp is increased beyond about 12 mm.

To accomplish the above-object, the high pressure sodium lamp includes an arc tube having an inner diameter. An amalgam including a prescribed quantity of sodium and mercury is sealed in the arc tube. To achieve the maximum lamp efficiency in different values of the inner diameter of the arc tube, the lamp should satisfy the following relationship:

$$(10^{0.848}\phi^{(-0.171)} \log X+(0.105\phi-10.22))$$

$$<\log Y<$$

$$(10^{0.848}\phi^{(-0.171)} \log X-10^{1.43}\,\phi^{(-0.574)})\text{, and}$$

$$(-7.97 \log \phi+14.8)<\log \Delta V<(84.7 \log \phi-84.5)$$

where $\phi$ (mm) is the inner diameter of the arc tube, X (wt%) is the ratio of the quantity of sodium to the quantity of amalgam sealed in the arc tube, Y (mg/cc) is the quantity of sodium sealed in the arc tube, and $\Delta V$ (v/cm) is the electric field strength when the lamp is operated.

BRIEF DESCRIPTION OF THE DRAWINGS

The present invention is best understood with reference to accompanying drawings in which.

DETAILED DESCRIPTION OF THE PREFERRED EMBODIMENT

In general, the following factors are considered to have influence on the lamp efficiency of a high pressure sodium lamp:

1. the inner diameter of an arc tube;
2. the length of the arc tube;
3. the transmittance of the arc tube;
4. the pressure of the rare gas sealed in the arc tube;
5. the quantity of sodium sealed in an arc tube;
6. the amalgam sodium ratio;
7. the electric field strength; and
8. the wall loading of the arc tube during lighting.

In the conventional design technique for a high pressure sodium lamp, the pressure of a rare gas sealed in the arc tube and the wall loading are increased within a practical range to enhance the lamp efficiency. However, the inventors found that the excessive degradation of the lamp efficiency resulting from the increase of the inner diameter of the arc tube can be avoided by carefully controlling the quantity of the sealed sodium, the amalgam sodium ratio and the electric field strength without increasing the pressure of the rare gas and the wall loading of the arc tube.

The inventors of the present invention conducted an extensive series of tests in which the amalgam sodium ratio, the quantity of the sodium and the electric field strength during lighting were varied for different values of inner diameter of the arc tube. As a result, an optimum condition for each variable was discovered.

Figure 4:
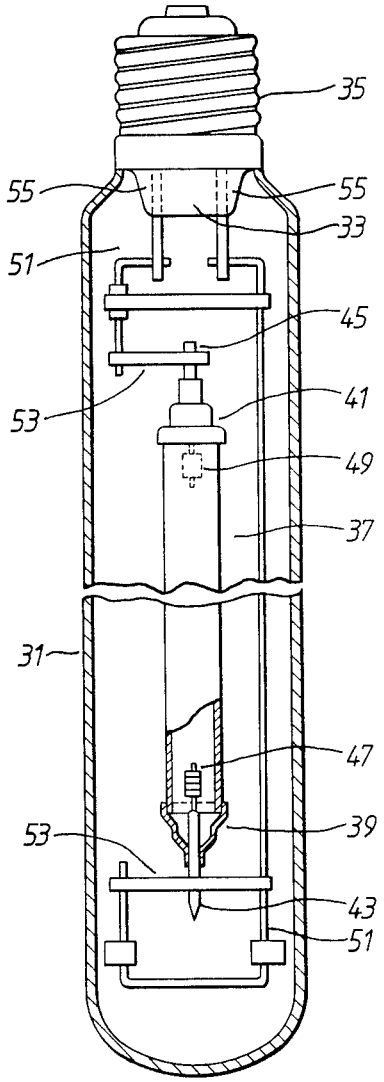
FIG. 4 is a sectional side view illustrating one embodiment of the present invention.

The construction of the high pressure sodium lamp now will be described. FIG. 4 is a cross sectional side view of a high pressure sodium lamp of one embodiment of the invention.

An outer tube 31 made of glass is provided with a stem 33 at its one end. A base 35 is fitted to the one end of outer tube 31 to seal tube 31. An arc tube 37 is housed in outer tube 31. Arc tube 37 is made of a light premeable ceramic having a 96% transmission factor. Both ends of arc tube 37 are individually sealed by sealing caps 39 and 41 made of niobium. One of electrode supporting tubes 43 and 45 is inserted into each of the individual sealing caps 39, 41, respectively. One of electrode supporting tubes 43 and 45 also serves as an exhausting tube. A pair of electrodes 47 and 49 is individually supported by electrode supporting tubes 43 and 45. Thus, each electrode is positioned at an opposite end portion of arc tube 37. A prescribed quantity of mercury and sodium are sealed in arc tube 37. Xenon also is provided in arc tube 37 as a starting rare gas at a prescribed sealed pressure, e.g., $2.67\times10^3$ Pa. The outer end of each electrode supporting tube 43, 45 is supported by an electroconductive support element 51 through an electroconductive holder 53. Furthermore, each support element 51 is electrically and mechanically connected to base 35 through a lead wire 55 supported by stem 33.

The following experiment was carried out with respect to an individual high pressure sodium lamp.

A 6 KW rated sodium lamp having an arc tube inner diameter of 36 mm, a separation distance between the pair of electrodes of 256 mm, a sealed amalgam sodium ratio of 15 wt% and 0.175 mg/cc of sealed sodium was tested. The relationship between the electric field strength and the lamp efficiency was obtained, as shown in FIG. 5, when the lamp was lit under different values of electric field strength, which varied in response to the temperature change of the coolest portion of the arc tube of the lamp.

Figure 5:
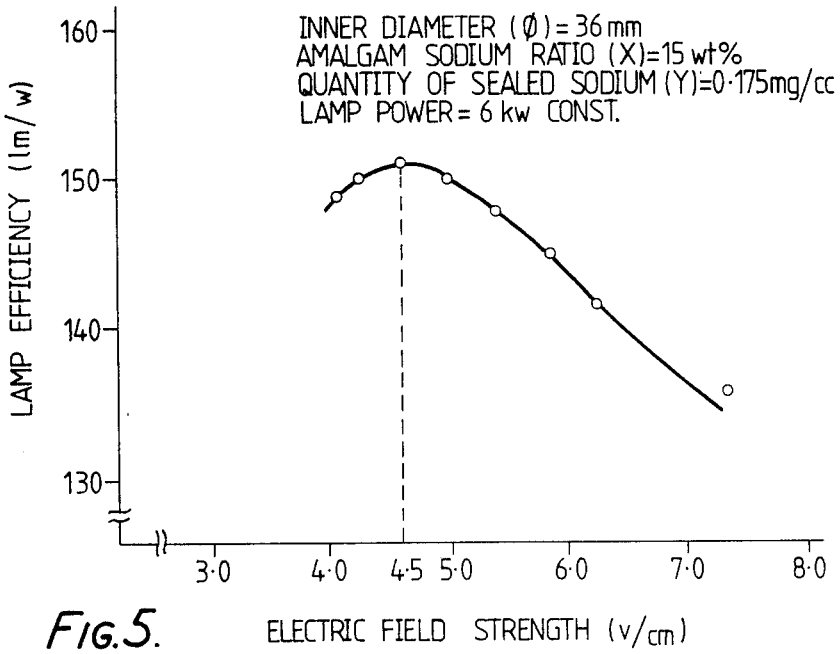
FIG. 5 is a graph showing the relationship between the lamp efficiency and the electric field strength when the inner diameter of the arc tube is 36 mm.

As can be understood from FIG. 5, the optimum electric field strength which gave the maximum lamp efficiency was 4.5 v/cm in the lamp constituted as described above.

Figure 6:
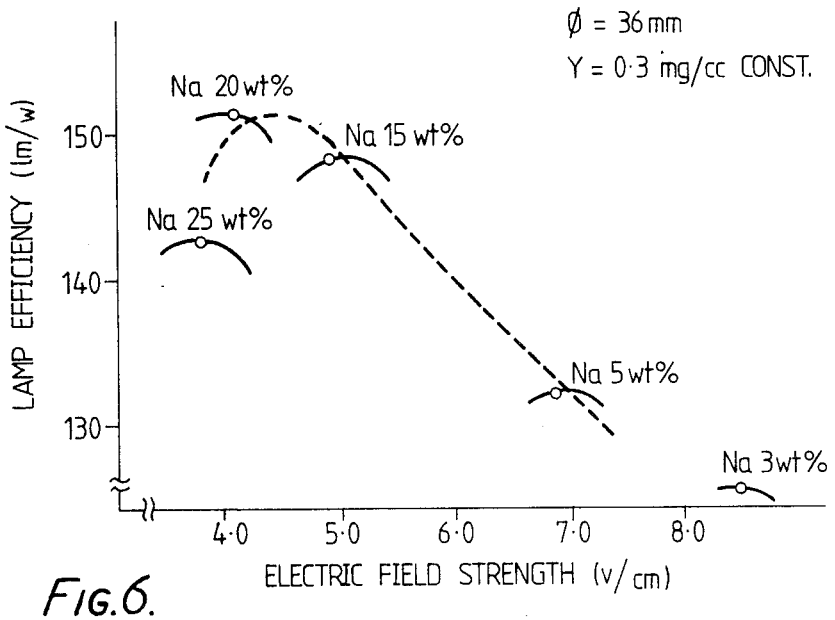
FIG. 6 is a graph showing the maximum lamp efficiency versus the electric field strength for the tube of FIG. 5 when the quantity of sealed sodium is 0.3 mg/cc, and the amalgam sodium ratio is varied between 3 wt% and 25 wt%.
Figure 7:
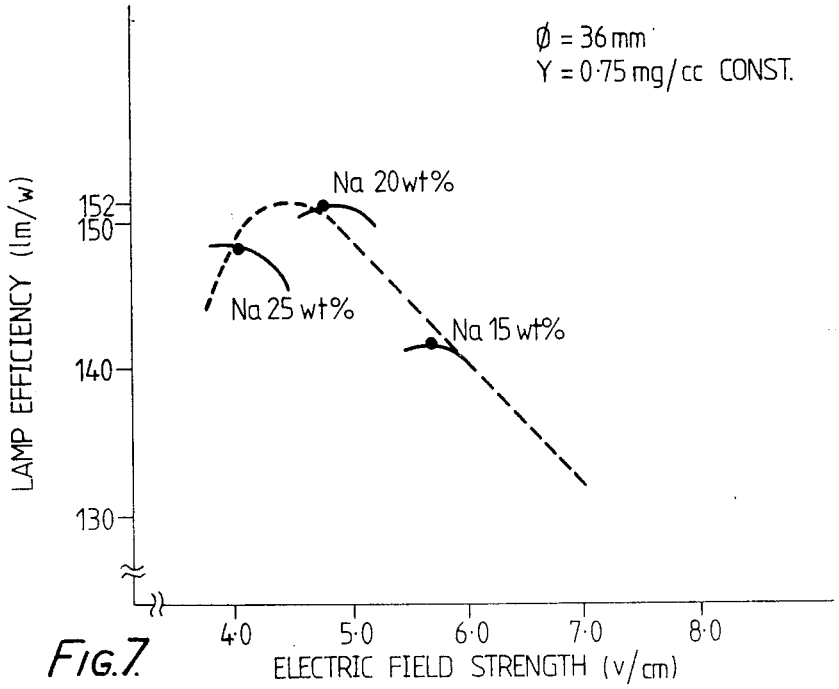
FIG. 7 is a graph showing the maximum lamp efficiency versus the electric field strength for the tube of FIG. 5 when the quantity of sealed sodium is 0.75 mg/cc, and the amalgam sodium ratio is varied between 15 wt% and 25 wt%.

The optimum electric field strength in comparison to an amalgam sodium ratio which varied between 3 wt% and 25 wt% was observed in a lamp with an arc tube inner diameter of 36 mm, a separation distance between the pair of electrodes of 256 mm, and 0.3 mg/cc of sealed sodium. The results are shown in FIG. 6. Similarly, a third experiment was carried out wherein 0.75 mg/cc of sealed sodium was contained in the lamp, and the amalgam sodium ratio was varied between 3 wt% and 25 wt%. The results are shown in FIG. 7. In FIGS. 6 and 7, the points of the maximum efficiency for each amalgam sodium ratio are connected to one another by a dotted line.

The dotted curved line in FIG. 6 coincides with the dotted curved line in FIG. 7. As can be understood from the above-description, the relationship between the electric field strength and the each maximum lamp efficiency follows a similar curved line, even though the quantity of the sealed sodium has changed.

Figure 8:
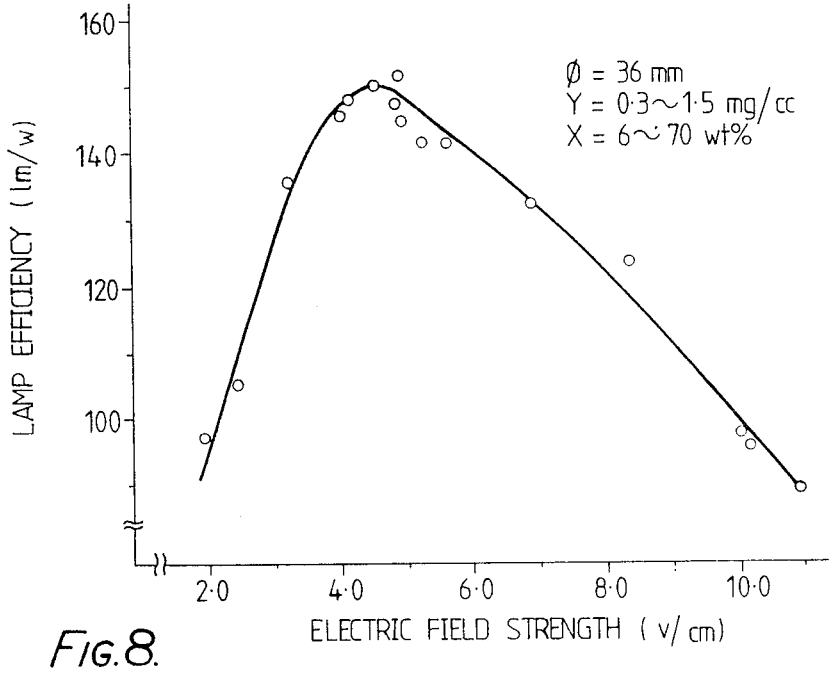
FIG. 8 is a graph showing the lamp efficiency versus the electric field strength for the tube of FIG. 5 when the quantity of sealed sodium and the amalgam sodium ratio are varied between predetermined limits.

A similar experiment was carried out with regard to various different quantities of sealed sodium between 0.5 mg/cc and 1.5 mm/cc, as shown in FIG. 8. In FIG. 8, all maximum lamp efficiency values obtained in the previous experiments are plotted. From FIG. 8, the specific relation between the lamp efficiency and the electric field strength may be confirmed. That is, the lamp efficiency varies in accordance with changes of the amalgam sodium ratio and the quantity of sealed sodium. However, in each case, the curved line connecting the maximum lamp efficiency values has a peak value when the electric field strength is 4.5 v/cm, as shown in FIG. 8.

Figure 9:
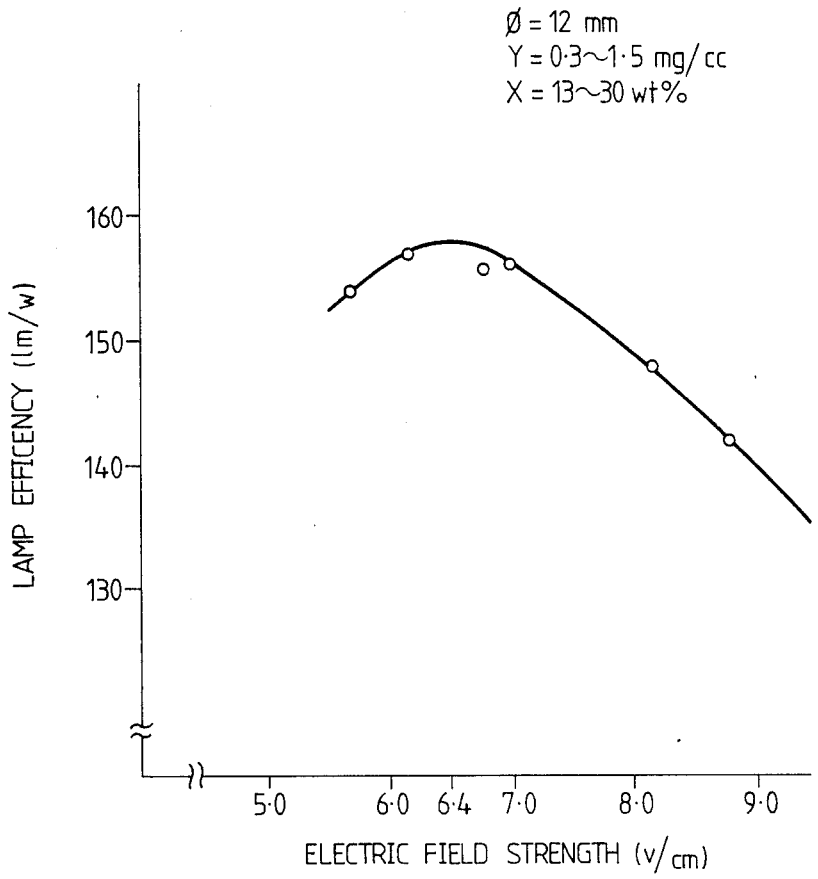
FIG. 9 is a graph similar to FIG. 8 showing the lamp efficiency compared with the electric field strength when the inner diameter of the arc tube is 12 mm.
Figure 10:
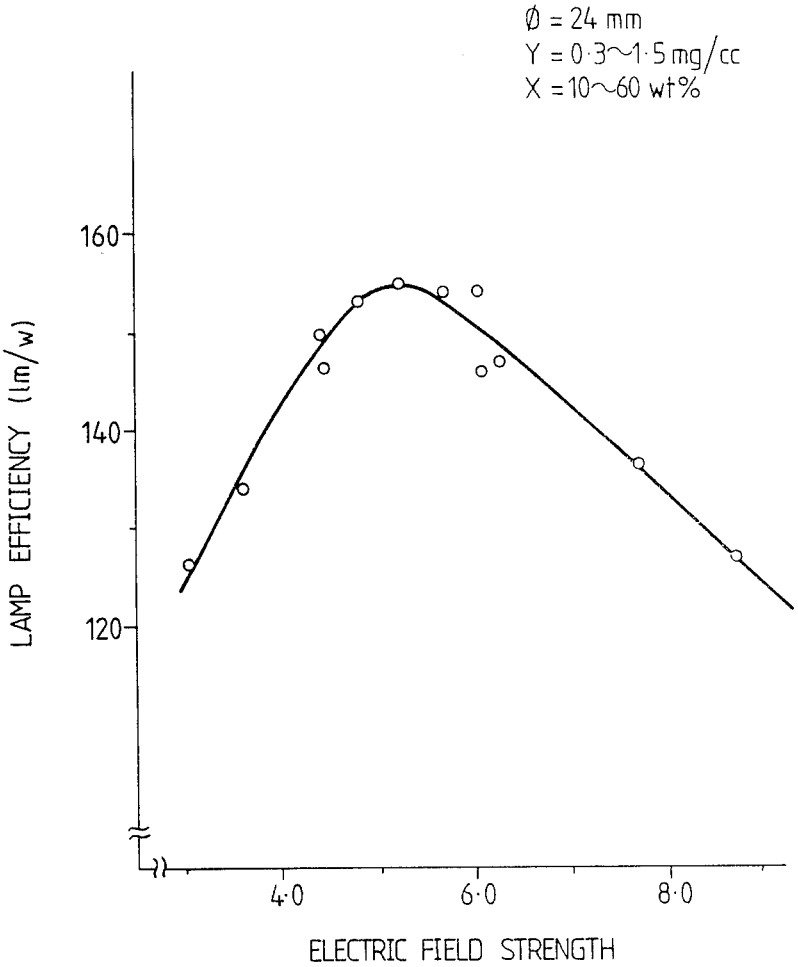
FIG. 10 is a graph similar FIG. 8 showing the lamp efficiency compared with the electric field strength when the inner diameter of the arc tube is 24 mm.
Figure 11:
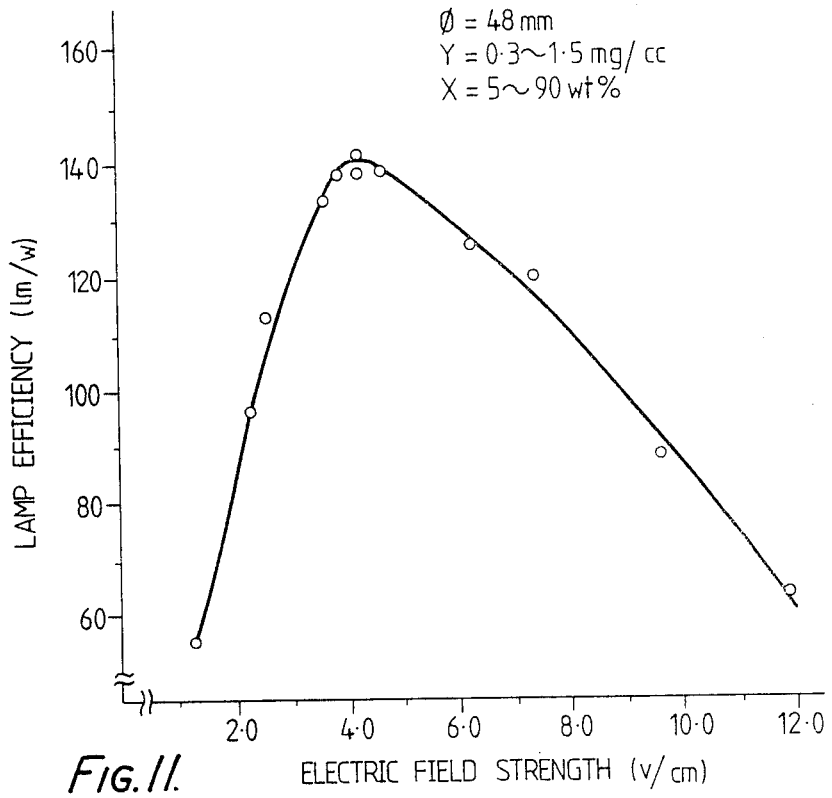
FIG. 11 is a graph similar to FIG. 8 showing the lamp efficiency compared with the electric field strength when the inner diameter of the arc tube is 48 mm.

FIG. 9, 10 and 11 show the lamp efficiency change compared with the electric field strength for each experiment when the inner diameter of the arc tube of the high pressure sodium lamp is varied between 12 mm and 48 mm. In each experiment, a plurality of lamps were used to observe the maximum efficiency of each lamp. The amalgam sodium ratio was varied between 5 wt% and 80 wt%, and the quantity of the sealed sodium also was varied between 0.3 mg/cc and 1.5 mg/cc.

In FIG. 9, the points of maximum lamp efficiency for each of a plurality of lamps are connected to one another by a solid line. Each lamp had an arc tube inner diameter of 12 mm. FIGS. 10 and 11 show graphs similar to FIG. 9 with regard to lamps having arc tube inner diameters of 24 mm and 48 mm.

According to the experiment described above, it is necessary to optimize the amalgam sodium ratio, the quantity of the sealed sodium and the electric field strength to achieve the maximum lamp efficiency. As shown in TABLE I, the relationship between the maximum lamp efficiency and the optimum electric field strength in connection with each inner diameter of the arc tube may be obtained from FIGS. 8, 9, 10 and 11.

TABLE I

| INNER DIAMETER OF ARC TUBE $\phi$ (mm) | MAXIMUM LAMP EFFICIENCY (lm/w) | OPTIMUM ELECTRIC FIELD STRENGTH V (v/cm) |
|---|---|---|
| 12 | 158 | 6.4 |
| 24 | 155 | 5.2 |
| 36 | 152 | 4.5 |
| 48 | 140 | 4.2 |

Figure 12:
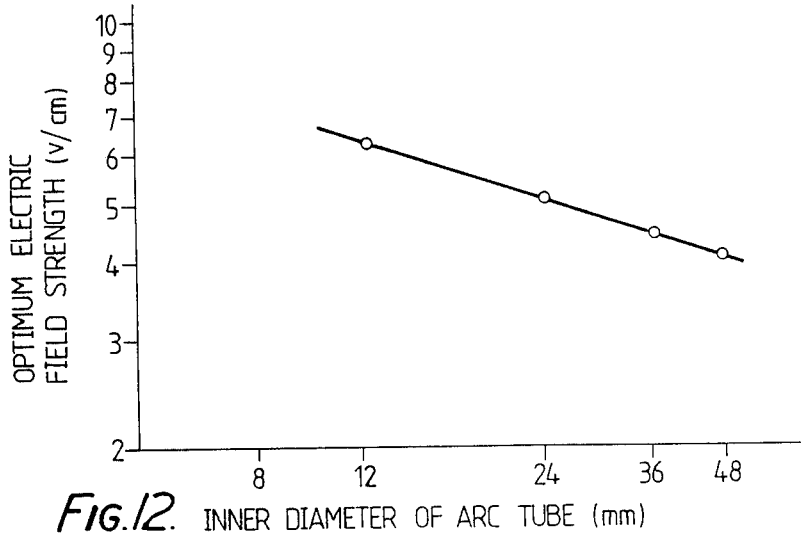
FIG. 12 is a graph showing the optimum electric field strength compared with the inner diameter of the arc tube.
Figure 13:
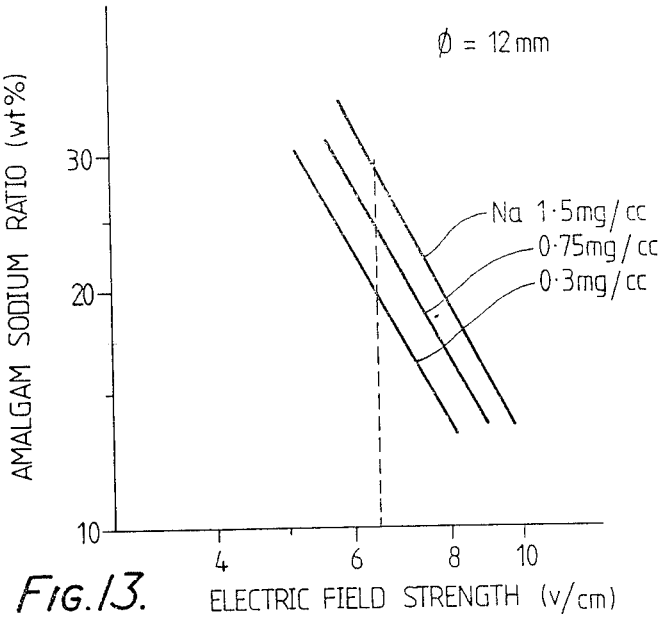
FIG. 13 is a graph showing the relationship between the amalgam sodium ratio and the electric field strength when the inner diameter is 12 mm, and the quantity of the sealed sodium is varied between 0.3 mg/cc and 1.5 mg/cc.
Figure 14:
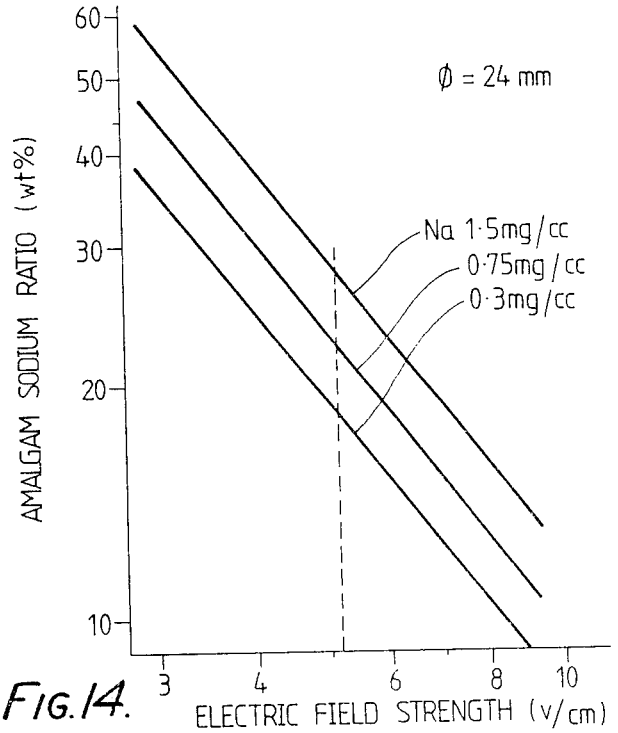
FIG. 14 is a graph showing the relationship between the amalgam sodium ratio and the electric field strength when the inner diameter of the arc tube is 24 mm, and the quantity of the sealed sodium is varied between 0.3 mg/cc and 1.5 mg/cc.

FIG. 12 shows a graph illustrating the relationship between the inner diameter of the arc tube and the optimum electric field strength shown in TABLE I. The graph shown in FIG. 12 may be expressed by the following equation:

$$\log \Delta V = -0.305 \log \phi + 1.13 \quad (1)$$

wherein $\Delta V$ is an electric field strength, and $\phi$ is the inner diameter of an arc tube.

Next, a plurality of high pressure sodium lamps wherein the amalgam sodium ratio was varied between 5 wt% and 80 wt%, and the quantity of the sealed sodium also was changed between 0.3 mg/cc and 1.5 mg/cc were manufactured. Each of the previous experiments was carried out on the above-described lamps to observe the optimum amalgam sodium ratio and the optimum quantity of the sealed sodium corresponding to the maximum lamp efficiency. FIGS. 13, 14, 15 and 16 show the results of these experiments.

As stated before, since the value of the optimum electric field strength compared with each inner diameter of the arc tube is approximated by the above-described equation (1), the intersection of each solid line and the perpendicular line from the value of the optimum electric field strength indicated by a dotted line, as shown in FIGS. 13, 14, 15 and 16, indicates the optimum amalgam sodium ratio and the optimum quantity of the sealed sodium for achieving the maximum lamp efficiency for each inner diameter of the arc tube. The following TABLE II shows the optimum amalgam sodium ratio for achieving the maximum lamp efficiency when the quantity of the sealed sodium is changed between 0.30 mg/cc and 1.50 mg/cc for each inner diameter of the arc tube tested. TABLE II corresponds to FIGS. 13, 14, 15 and 16.

TABLE II

| INNER DIAMETER OF ARC TUBE $\phi$ (mm) | QUANTITY OF SEALED SODIUM Y (mg/cc) | AMALGAM SODIUM RATIO x (wt %) |
|---|---|---|
| 12 | 0.30 | 19.8 |
| | 0.75 | 25.0 |
| | 1.50 | 28.5 |
| 24 | 0.30 | 18.2 |
| | 0.75 | 24.1 |
| | 1.50 | 27.5 |
| 36 | 0.30 | 17.7 |
| | 0.75 | 22.4 |
| | 1.50 | 26.9 |
| 48 | 0.30 | 16.8 |
| | 0.75 | 20.9 |
| | 1.50 | 26.2 |

Figure 15:
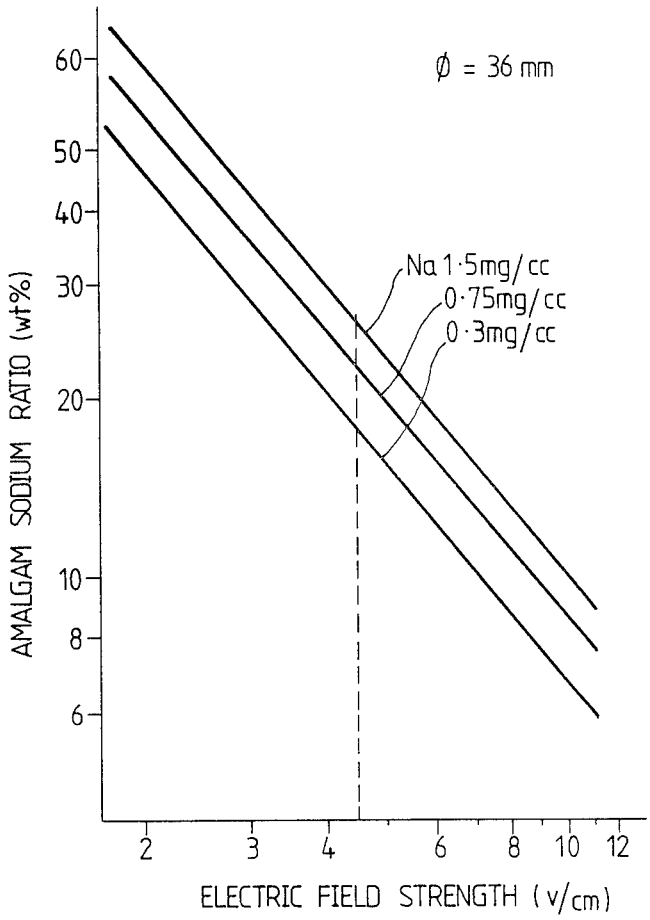
FIG. 15 is a graph showing the relationship between the amalgam sodium ratio and the electric field strength when the inner diameter of the arc tube is 36 mm, and the quantity of the sealed sodium is varied between 0.3 mg/cc and 1.5 mg/cc.
Figure 16:
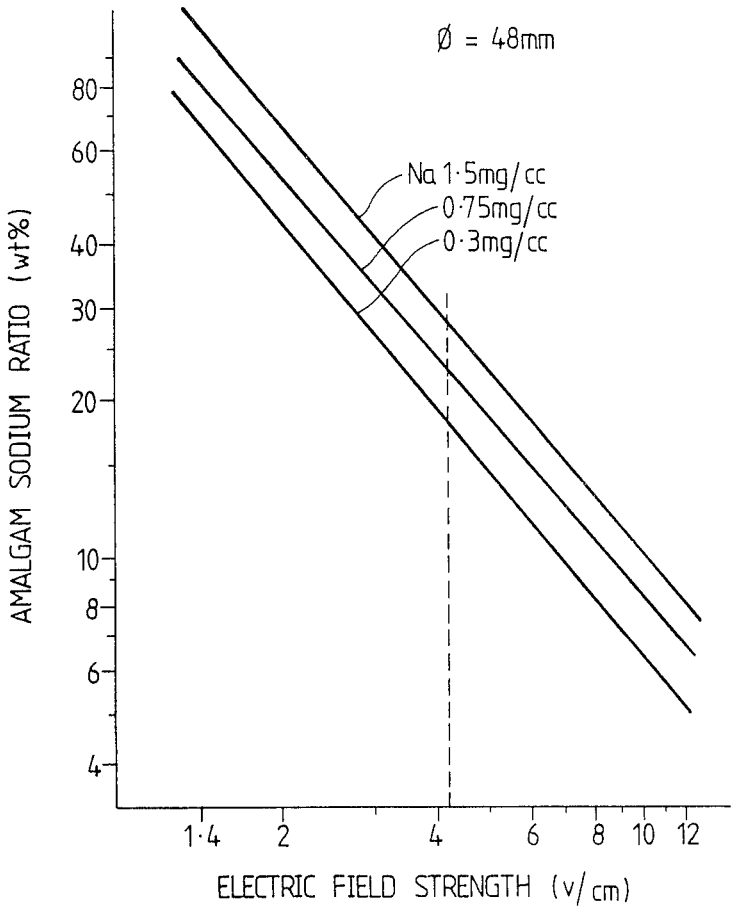
FIG. 16 is a graph showing the relationship between the amalgam sodium ratio and the electric field strength when the inner diameter of the arc tube is 48 mm, and the quantity of the sealed sodium is varied between 0.3 mg/cc and 1.5 mg/cc.

As can be understood from the above-description, when the arc tube inner diameter is 36 mm, the quantity of sealed sodium is 1.5 mm/cc, and the amalgam sodium ratio is 26.9 wt%, the maximum lamp efficiency is achieved when the lamp is lit under approximately 5 v/cm of electric field strength, as shown in FIG. 15.

Figure 17:
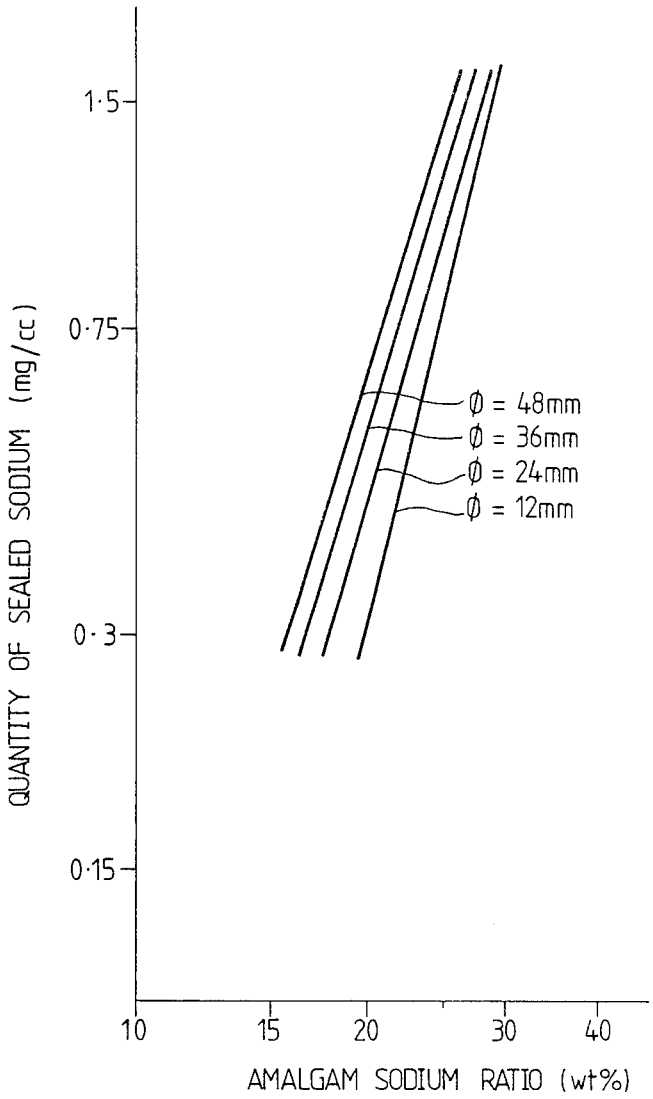
FIG. 17 is a graph showing the optimum relationship between the quantity of the sealed sodium and the amalgam sodium ratio when the inner diameter of the arc tube is 12 mm, 24 mm, 36 mm and 48 mm.
Figure 18:
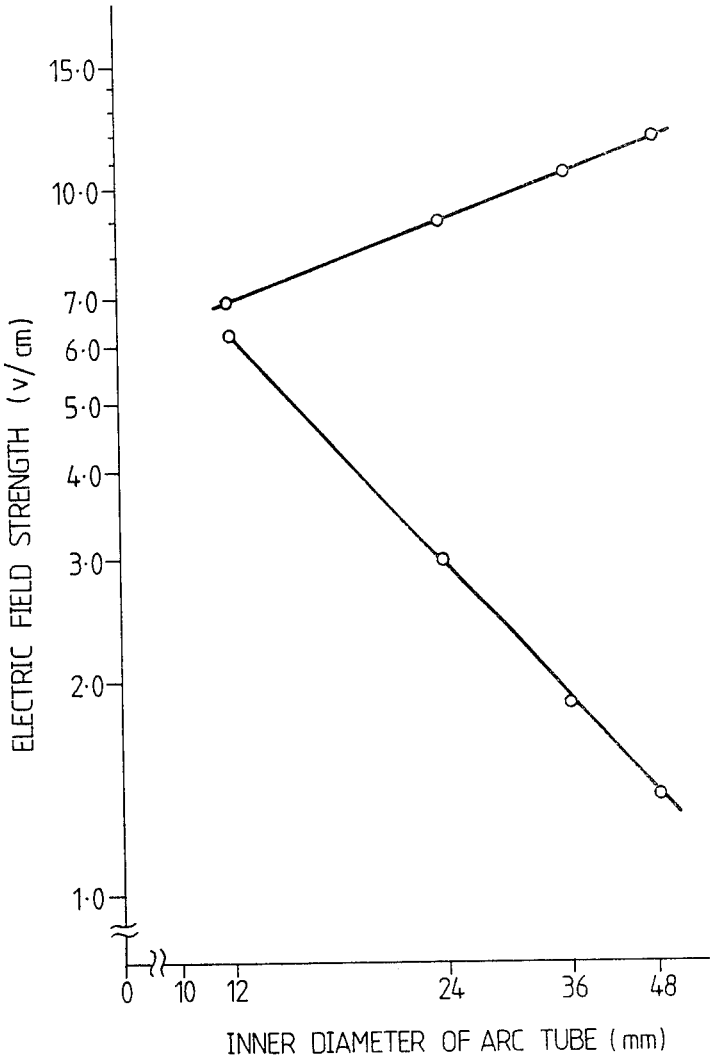
FIG. 18 is a graph showing the upper and lower limit values of the electric field strength plotted against the inner diameter of the arc tube when a lamp efficiency greater than that of the conventional lamp is achieved.

FIG. 17 shows the relationship between the quantity of sealed sodium and the amalgam sodium ratio when the maximum lamp efficiency is achieved for each different inner diameter of the arc tube. As can be seen in FIG. 17, the above-described relationship is approximated by the following equation:

$$\log Y = B \log X + C \quad (2)$$

where Y is the quantity of the sealed sodium, X is the amalgam sodium ratio, and B and C are constants.

B and C for each inner diameter of the arc tube are obtained from the above-described experiments, as shown in TABLE III.

TABLE III

| $\phi$ | B | −C |
|---|---|---|
| 12 | 4.55 | 6.45 |
| 24 | 4.14 | 5.79 |
| 36 | 3.84 | 5.31 |
| 48 | 3.63 | 4.95 |

The following equations are derived from TABLE III.

$$\log B = (-0.171) \log \phi + 0.848 \quad (3)$$

$$\log (-C) = (-0.200) \log \phi + 1.033 \quad (4)$$

Therefore, the following equation is obtained by substituting equations (3), (4) into equation (2).

$$\log Y = 10^{0.848} \phi^{(-0.171)} \log X - 10^{1.033} \phi^{(-0.200)} \quad (2)'$$

As can be understood from the above-description, the maximum lamp efficiency is achieved for each inner diameter of the arc tube when following equations are satisfied:

$$\log V = -0.305 \log \phi + 1.13 \quad (1)$$

$$\log Y = 10^{0.848} \phi^{(-0.171)} \log X - 10^{1.33} \phi^{(-0.200)} \quad (2)'$$

Figure 1:
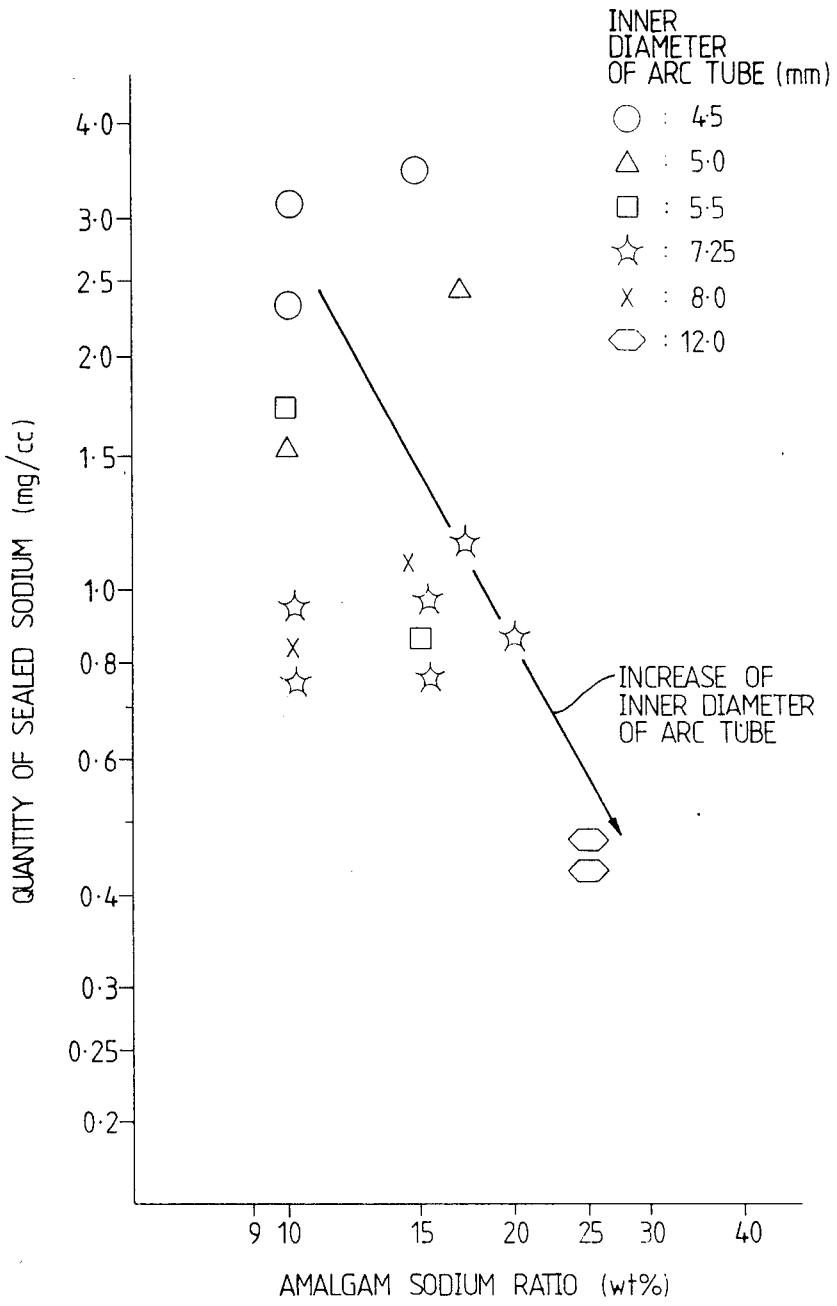
FIG. 1. PRIOR ART
FIG. 1 is a graph showing the relationship between the amalgam sodium ratio and the quantity of sodium in an amalgam sealed in an arc tube for different values of the inner diameter of the arc tube in a conventional high pressure sodium lamp.
Figure 2:
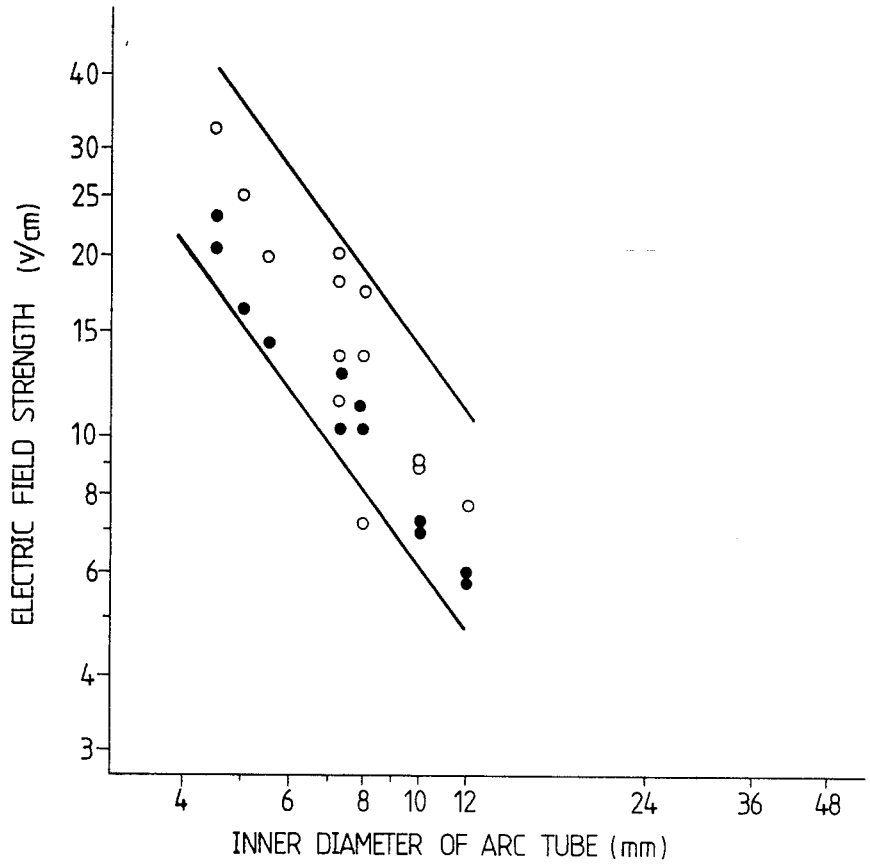
FIG. 2. PRIOR ART
FIG. 2 is a graph showing the relationship between the inner diameter of the arc tube and the electric field strength of the conventional high pressure sodium lamp shown in FIG. 1.
Figure 3:
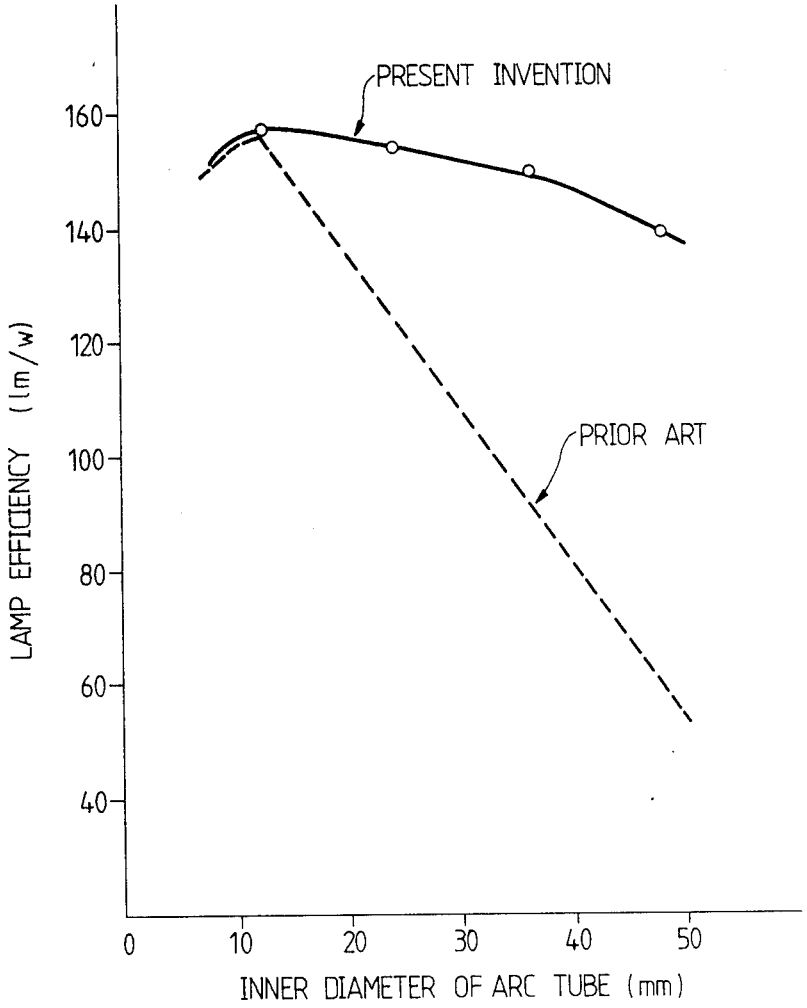
FIG. 3 is a graph showing the maximum lamp efficiency of one embodiment of the present invention and of the conventional sodium lamp, for different values of inner diameter of the arc tube.

The lamp efficiency of the high pressure sodium lamp which satisfies the above-described equations (1) and (2)′ is indicated by solid line in FIG. 3. On the other hand, the lamp efficiency of a conventional high pressure sodium lamp is indicated by dotted line in FIG. 3. As will be clearly understood from FIG. 3, enhancement of the lamp efficiency is achieved in the high pressure sodium lamp of this embodiment.

A lamp efficiency higher than that of the conventional lamp may be achieved from FIG. 3. As can be understood from FIG. 3, when the inner diameter of the arc tube exceeds 48 mm, the lamp efficiency thereof has to achieve at least 59 lm/w in order to exceed the lamp efficiency of the conventional lamp. Likewise, when the inner diameter exceeds 36 mm, the lamp efficiency has to achieve at least 91 lm/w. When the inner diameter exceeds 24 mm, the lamp efficiency has to achieve at least 124 lm/w. When the inner diameter exceeds 12 mm, the lamp efficiency has to achieve at least 157 lm/w.

Each electric field strength range in which a lamp efficiency greater than the above-described lower limit values is achieved, is shown in TABLE IV, which is derived from FIGS. 8, 9, 10 and 11.

TABLE IV

| INNER DIAMETER OF ARC TUBE $\phi$ (mm) | ELECTRIC FIELD STRENGTH (v/cm) | |
|---|---|---|
| | LOWER LIMIT | UPPER LIMIT |
| 12 | 6.2 | 6.9 |
| 24 | 3.0 | 9.0 |
| 36 | 1.9 | 10.8 |
| 48 | 1.4 | 12.0 |

The upper limit value and the lower limit value of the electric field strength in each inner diameter of the arc tube shown in TABLE IV is approximated with the following equations:

$$\log \Delta Vl = -7.97 \log \phi + 14.8 \text{ (lower limit value)}$$

$$\log \Delta Vu = 84.7 \log \phi - 84.5 \text{ (upper limit value)}$$

As can be understood from the above-equations, a suitable electric field strength range greater than that of the conventional lamp should satisfy the following relationship:

$$(-7.97 \log \phi + 1.48) < \log \Delta V < (84.7 \log \phi - 84.5) \quad \text{(A)}$$

TABLE V shows the range of the amalgam sodium ratio (X) and the range of the quantity of the sealed sodium (Y) corresponding to the above-described upper and lower limit values of the electric field strength for each inner diameter of the arc tube. Each range shown in TABLE V is derived from FIGS. 13, 14, 15 and 16.

TABLE V

| | $\phi$ = 12 (mm) | | $\phi$ = 24 (mm) | | $\phi$ = 36 (mm) | | $\phi$ = 48 (mm) | |
|---|---|---|---|---|---|---|---|---|
| | Y (mg/cc) | X (wt %) | Y (mg/cc) | X (wt %) | Y (mg/cc) | X (wt %) | Y (mg/cc) | X (wt %) |
| LOWER LIMIT | 0.3 | 22 | 0.3 | 37 | 0.3 | 50 | 0.3 | 62 |
| | 0.75 | 27 | 0.75 | 45 | 0.75 | 61 | 0.75 | 75 |
| | 1.5 | 32 | 1.5 | 54 | 1.5 | 74 | 1.5 | 94 |
| UPPER LIMIT | 0.3 | 17.5 | 0.3 | 9.0 | 0.3 | 6.0 | 0.3 | 4.6 |
| | 0.75 | 22.5 | 0.75 | 11.5 | 0.75 | 7.8 | 0.75 | 5.9 |
| | 1.5 | 26.0 | 1.5 | 13.5 | 1.5 | 9.0 | 1.5 | 6.9 |

$\phi$: inner diameter of arc tube,
Y: quantity of sealed sodium,
X: amalgam sodium ratio The relationship between the amalgam sodium ratio and the quantity of the sealed amalgam against each inner diameter of the arc tube shown in TABLE V is approximated with the following relationships:

$$4.55 \log X - 6.64 < \log Y < 4.55 \log X - 6.23$$

when the inner diameter of the arc tube is 12 mm;

$$4.14 \log X - 6.99 < \log Y < 4.14 \log X - 4.50$$

when the inner diameter is 24 mm;

$$3.84 \log X - 7.01 < \log Y < 3.84 \log X - 3.52$$

when the inner diameter is 36 mm; and $$3.63 \log X - 6.98 < \log Y < 3.63 \log X - 2.91$$

when the inner diameter is 48 mm.

Furthermore, the above-described equations also may be expressed by the following equation with regard to the inner diameter of the arc tube:

$$(10^{0.848\phi^{(-0.171)}} \log X + (0.105\phi - 10.22)) < \log Y < (10^{0.848\phi^{(-0.171)}} \log X - 10^{1.43\phi^{(-0.574)}}) \quad \text{(B)}$$

As stated above, when the inner diameter of the arc tube of a high pressure arc lamp is greater than 12 mm, the lamp efficiency thereof may exceed that of the conventional lamp if the contents of the high pressure arc lamp, e.g., the amalgam sodium ratio and the quantity of the sodium satisfy the above-described equations (A) and (B).

In the above-described embodiment, each experiment was carried out with regard to inner diameters of 12 mm, 24 mm, 36 mm, and 48 mm. However, the present invention may be applied to any sodium lamps which have inner diameters greater than 12 mm.

The present invention has been described with respect to a specific embodiment. However, other embodiments based on the principles of the present invention will be obvious to those of ordinary skill in the art. Such embodiments are intended to be covered by the claims.

What is claimed is:

1. A high pressure sodium lamp for operation under a prescribed electric field strength, comprising:

an arc tube having an inner diameter; and an amalgam including a prescribed quantity of sodium and mercury sealed in the arc tube, the amalgam substantially satisfying the following relationship:

$$(10^{0.848\phi^{(-0.171)}} \log X + (0.105\phi - 10.22))$$

$<\log Y<$ $(10^{0.848}\phi^{(-0.171)} \log X - 10^{1.43}\phi^{(-0.574)})$, and the field strength satisfying the following relationship:

$(-7.97 \log\phi + 14.8) < \log \Delta V < (84.7 \log \phi - 84.5)$, where $\phi$ (mm) is the inner diameter of the arc tube and is greater than 12 mm, X (wt%) is the ratio of the quantity of sodium to the quantity of amalgam sealed in the arc tube, Y (mg/cc) is the quantity of the sodium sealed in the arc tube, and $\Delta V$ (v/cm) is the electric field strength when the lamp is operated.

2. A lamp according to claim 1 further including electrode means for generating an arc in the tube.

3. A lamp according to claim 1 further including an outer tube.

4. A lamp according to claim 1, wherein the arc tube includes starting rare gas.

5. A lamp according to claim 1, wherein the arc tube includes a light permeable ceramic material.

* * * * *